US006966545B2

(12) United States Patent
Eising et al.

(10) Patent No.: US 6,966,545 B2
(45) Date of Patent: Nov. 22, 2005

(54) CHAIN BLOCK

(75) Inventors: Ralf Eising, Herne (DE); Oliver Moll, Solingen (DE); Torsten Sattler, Sprockhövel (DE); Thilo Walloschek, Gevelsberg (DE); Rüdiger Ostholt, Wetter (DE)

(73) Assignee: Demag Cranes & Components GmHB, (DE)

( * ) Notice: Subject to any disclaimer, the term of this patent is extended or adjusted under 35 U.S.C. 154(b) by 31 days.

(21) Appl. No.: 10/668,053

(22) Filed: Sep. 22, 2003

(65) Prior Publication Data

US 2004/0149972 A1 Aug. 5, 2004

(30) Foreign Application Priority Data

Sep. 23, 2002 (DE) ..... 102 44 865

(51) Int. Cl.[7] ..... B66D 1/20
(52) U.S. Cl. ..... 254/358; 254/372
(58) Field of Search ..... 254/346, 350, 254/358, 368, 372

(56) References Cited

U.S. PATENT DOCUMENTS

| | | | | |
|---|---|---|---|---|
| 2,652,230 A * | 9/1953 | Hoyle et al. | 254/346 |
| 2,800,985 A * | 7/1957 | Ronceray | 192/215 |
| 2,891,767 A * | 6/1959 | Armington, Jr. | 254/344 |
| 3,811,657 A * | 5/1974 | Hoover | 254/367 |
| 3,817,494 A * | 6/1974 | Eckerdt | 254/330 |
| 3,915,022 A * | 10/1975 | Walton | 74/99 R |
| 4,508,318 A * | 4/1985 | Maeda | 254/350 |
| 4,605,111 A * | 8/1986 | Ohno et al. | 192/16 |
| 5,123,630 A * | 6/1992 | Watson et al. | 254/346 |
| 5,398,911 A * | 3/1995 | Holster | 254/267 |
| 6,554,255 B2 * | 4/2003 | Fujikawa | 254/358 |

FOREIGN PATENT DOCUMENTS

| | | |
|---|---|---|
| DE | 701034 | 1/1941 |
| DE | 3135055 | 4/1983 |
| DE | 3706325 | 9/1988 |
| DE | 69211905 | 7/1996 |
| DE | 19927847 | 10/2000 |
| GB | 355307 | 8/1931 |

* cited by examiner

*Primary Examiner*—Emmanuel M Marcelo
(74) *Attorney, Agent, or Firm*—Van Dyke, Gardner, Linn & Burkhart, LLP

(57) ABSTRACT

A chain block with a drive motor (2) with a motor shaft (11), which is connected at the take-off side via a slip clutch (50) to a transmission input shaft (14), having a first gear (18*a*) and mounted in a housing (1) by pivot bearings (13, 13*a*), of an at least one-stage transmission (3). In order to create a simple design of chain block with a slip clutch, the transmission input shaft (14) is to be mounted floating in the pivot bearings (13, 13*a*) in order to change the frictional force of the slip clutch (50).

15 Claims, 2 Drawing Sheets

CHAIN BLOCK

BACKGROUND OF THE INVENTION

The invention concerns a chain block with a drive motor with a motor shaft, which is connected at the take-off side, across a slip clutch, to a transmission input shaft, having a first gear and mounted in a housing via pivot bearings, of an at least one-stage transmission.

From German patent DE 199 27 847 C1 there is a known chain block with an electric drive motor, whose motor shaft is connected to a secondary transmission. The motor shaft is connected via a slip clutch to an input shaft of the transmission. On the end of the transmission input shaft opposite the drive motor is arranged an electromagnetically activated disk brake. The slip clutch is fashioned as a one or two disk clutch and essentially consists, in the one-disk clutch configuration, of a clutch disk with a clutch lining, joined to the motor shaft so as to rotate with it, and a pressure disk which can be forced against the clutch lining, which is mounted on the transmission input shaft and can move in the lengthwise direction. In order to allow the pressure disk to be subjected to the desired pressing force in the direction of the clutch lining, the pressure disk is connected to a pressure rod, which is led through the transmission input shaft, fashioned as a hollow shaft. The end of the pressure rod projecting out from the end of the transmission input shaft opposite the clutch is connected to a tension spring and a thread adjustment nut so that the pressing force on the pressure rod and thus the maximum torque which can be transmitted by the clutch can be adjusted via the thread adjustment nut. Since the transmission input shaft and the pressure rod project outward beyond the disk brake, the thread adjustment nut is easy to reach for the adjustment. The configuration of the transmission input shaft as a hollow shaft and the use of the pressure rod, on the other hand, are very cumbersome in design.

SUMMARY OF THE INVENTION

The basic problem of the invention is to create a simple design for a chain block with a slip clutch.

The problem is solved by a chain block with the features of claim 1. Subsidiary claims 2 through 11 contain advantageous configurations of the chain block.

According to the invention, in a chain block with a drive motor with a motor shaft, which is connected at the take-off side via a slip clutch to a transmission input shaft of an at least one-stage transmission that has a first gear and that is mounted in a housing via pivot bearings, a simple design structure is characterized in that the transmission input shaft is mounted floating in the pivot bearings so as to alter the frictional force of the slip clutch. The arrangement of the transmission input shaft so that it can move in axial direction allows an especially easy adjustment of the tensioning force of the slip clutch. A compact construction is achieved in that the slip clutch is arranged next to the first gear on the transmission input shaft and thrusts against one of the pivot bearings.

It is especially advantageous when the first gear of the transmission input shaft is configured in a spiral gearing so that, during operation of the chain block, the axial force exerted by the spiral gearing results in a change in frictional force of the slip clutch in the lengthwise direction of the transmission input shaft. In this way, one can achieve an automatic changing of the release torque without changing the setting of the release torque of the slip clutch during operation of the chain block, as opposed to standstill of the chain block. In a preferred embodiment, the axial force exerted by the spiral gearing results in an increased frictional force of the slip clutch, preferably when hoisting. This has the accompanying benefit that, upon reversal of the direction of force flow in the transmission by an interlocking of the chain at the no-load side, the axial force of the gearing then counteracts the pretensioning of the spring element and the torque releasing the slip clutch is reduced. This lessens the danger of damage to the chain block.

In a preferred design, the transmission input shaft at one end is supported against the second pivot bearing by a spring element for activating the slip clutch, and the spring element consists of disk spring elements. An especially easy adjustment of the pretensioning of the spring element is achieved because the pivot bearing can move lengthwise in the housing and can be moved in the direction of the spring element by a set screw which thrusts against the housing.

In order to prevent a crashing down of the load upon failure of the slip clutch, a brake is arranged at the end of the transmission input shaft away from the slip clutch, which acts on the transmission input shaft. In a preferred embodiment, the brake is secured to the housing, elevated at a distance from the set screw. In this way, the set screw remains easy to reach and one can also use a standard brake. This brake is preferably configured as an electromagnetically activated disk brake.

In preferred structural design, the slip clutch essentially consists of a pressure disk, which thrusts against the first pivot bearing, and a clutch disk with a clutch lining, against which the transmission input shaft thrusts.

These and other objects, advantages and features of this invention will become apparent upon review of the following specification in conjunction with the drawings.

BRIEF DESCRIPTION OF THE DRAWINGS

A sample embodiment of the invention shall be described by means of a drawing. This shows.

DETAILED DESCRIPTION OF THE PREFERRED EMBODIMENT

Figure 1:
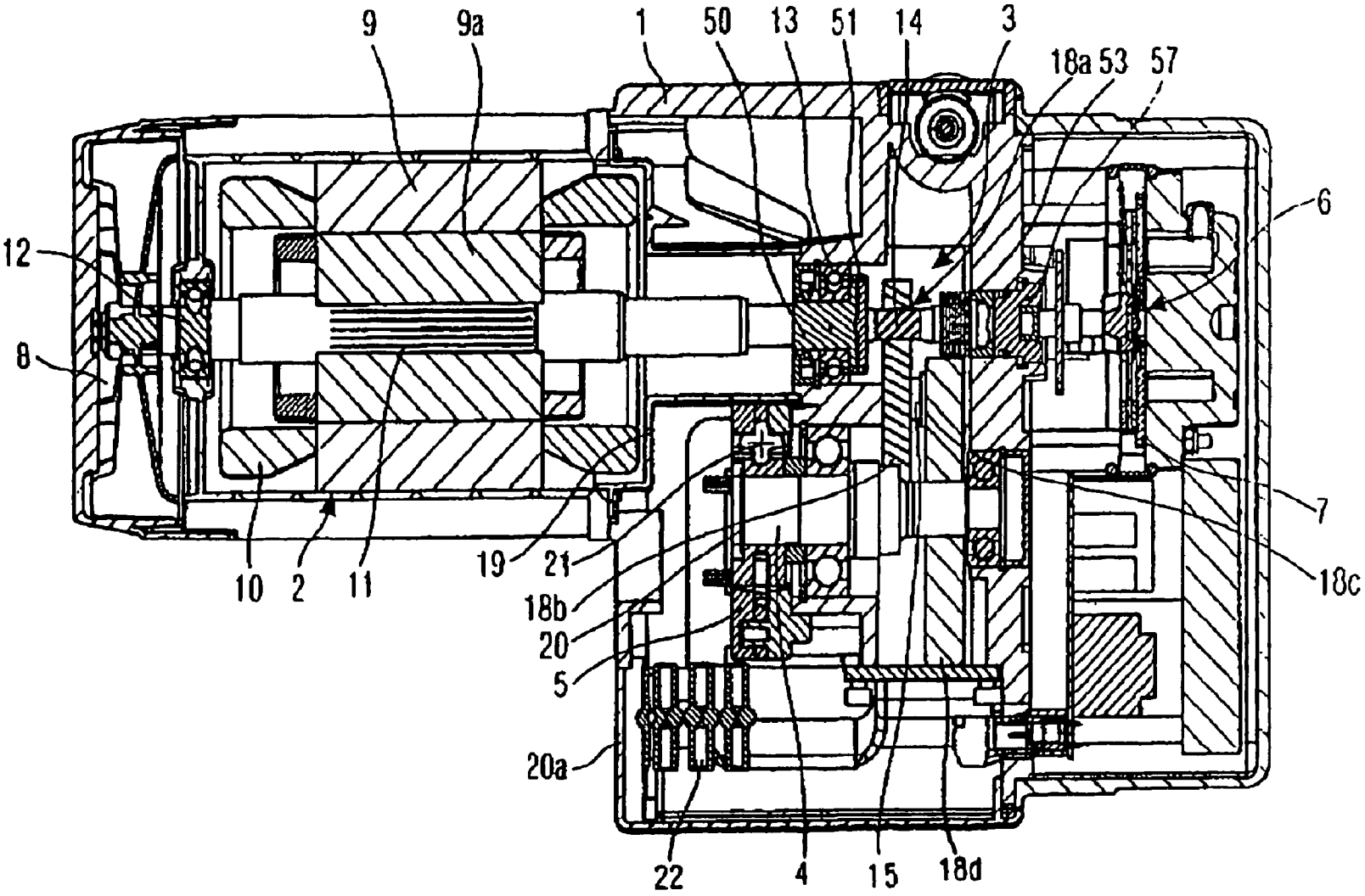
FIG. 1 a lengthwise section through a chain block.

FIG. 1 shows a lengthwise section of a chain block, which is arranged in a housing 1. The chain block includes, as a driving arrangement, an electric drive motor 2 and a secondary transmission 3 with two transmission stages. On its transmission output shaft 4, rigidly connected to it, there is a chain wheel 5 for the chain. The chain block can be hung by means of a lug from a supporting element (neither of them shown).

The motor 2 has a stator 9, a rotor 9*a*, a motor winding 10 and a motor shaft 11, which is supported by motor pivot bearings 12 and a first pivot bearing 13, while the first pivot bearing 13 at the drive side supports the motor shaft 11 and the transmission input shaft 14 at the same time.

The transmission input shaft 14 is provided with a spiral gearing in order to form a first gear 18*a* of the first transmission stage of the transmission 3 between the first pivot bearing 13 and the second pivot bearing 13*a*. The first gear 18*a* of the first transmission stage meshes with a second gear 18*b* with a corresponding spiral gearing, which is mounted on a transmission shaft 15 oriented parallel to the transmission output shaft 4 and to the transmission input shaft 14. On this transmission shaft 15 there is placed a third gear 18*c* from the second transmission stage, which meshes with a fourth gear 18*d* rigidly placed on the transmission output shaft 4 and thus drives the transmission output shaft 4. All of the transmission shafts 4, 14 and 15 run parallel to each other.

As FIG. 1 shows, the chain wheel 5 faces the take-off end face 19 of the drive motor 2, and the distance between the chain wheel 5 and this end face 19 is chosen so that the chain wheel 5, placed floating on the shaft 4, can be pulled away from the transmission output shaft 4 and toward the end face 19 by loosening a fastening ring 20. Before loosening the chain wheel 5, it is necessary to take off a cover piece 20*a*.

Figure 2:
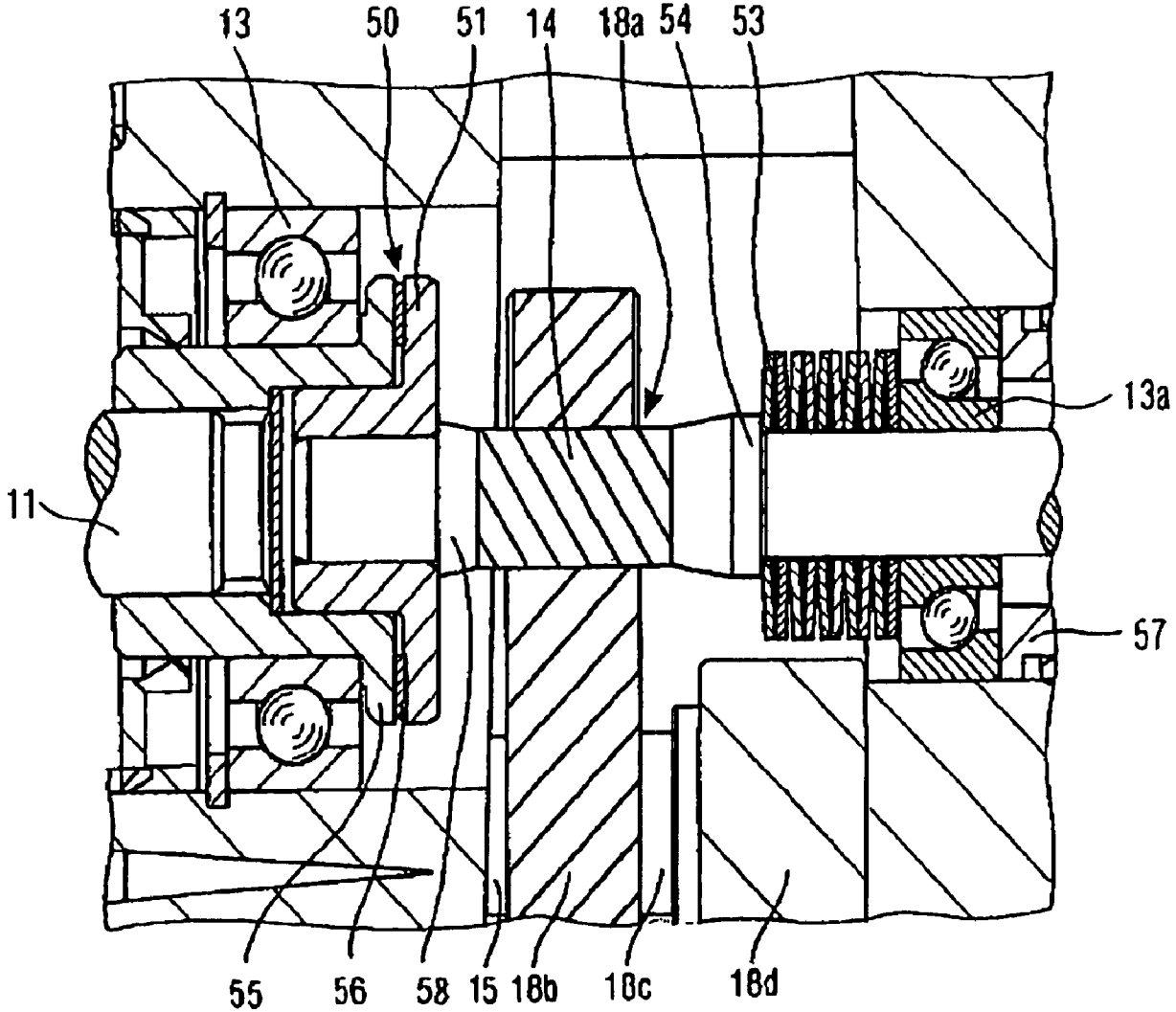
FIG. 2 a magnified feature of claim 1 from the region of the first transmission stage.

Furthermore, it will be noticed from FIG. 1 and FIG. 2, which shows an enlarged feature of FIG. 1 from the region of the first transmission stage with the first and second gear 18*a*, 18*b*, that the transmission input shaft 14 is mounted floating; i.e., it can move in axial direction, by the first pivot bearing 13 and the second pivot bearing 13*a* in the housing 1. For this, the outer ring of the second pivot bearing 13*a* can move in the housing 1 and the inner ring of the second pivot bearing 13*a* can move on the transmission input shaft 14.

As overload protection, a slip clutch 50 is inserted between the motor shaft 11 and the transmission input shaft 14. The slip clutch 50 basically consists of a clutch disk 51 with a ring-shaped clutch lining 56, a pressure disk 55, and a spring element 53 to create a pretensioning between pressure disk 55 and clutch disk 51. The clutch disk 51 consists of a sleevelike central part, one end of which has a ring-shaped flange to accommodate the clutch lining 56. The sleevelike central part of the clutch disk 51 is inserted into the sleevelike central part of the similarly designed pressure disk 55, led through in radial direction, and thrusts in axial direction against the ring-shaped flange of the pressure disk 55, across the clutch lining 56. The pressure disk 55, in turn, thrusts with its ring-shaped flange against the inner ring of the first pivot bearing 13, at the side opposite the clutch lining 56, while the outer ring of the bearing is secured in axial direction relative to the housing 1. At the end of the pressure disk 55 opposite the slip clutch 50, the motor shaft 11 is rigidly inserted into the sleevelike part of the pressure disk 55.

In order to place the slip clutch 50 under a pretensioning which determines the maximum supportable torque, there is provided the spring element 53, which preferably consists of flat springs thrusting against each other and arranged on the transmission input shaft 14. The pack of spring elements 53 at one side thrusts against the transmission input shaft 14 via a first shoulder 54 formed by a conical enlargement, and at the other side it thrusts against the inner ring of the second pivot bearing 13*a*. Thus, the pretensioning of the spring elements 53 can be transmitted by the first shoulder 54 to the transmission input shaft 14 and by a second shoulder 58 arranged behind the first gear 18*a* to the sleevelike part of the clutch disk 51.

In order to adjust the pretensioning of the spring element 53 as desired, there is provided a threaded set screw 57, thrusting against the housing 1, and placed against the outer ring of the second pivot bearing 13*a*. Thus, by turning the set screw 57, the axial position of the second pivot bearing 13*a* and, through it, the degree of pretensioning in the spring element 53 can be changed.

Furthermore, from FIG. 1, it is noticed that a brake 6, preferably configured as an electromagnetically operated disk brake, is arranged by an anchor plate 7 on the end of the transmission 3 away from the drive motor 2. This brake 6, engaging with the transmission input shaft 14, has the function of protecting the load, suspended from the chain block, from crashing down when the slip clutch fails. Furthermore, the brake 6 is arranged at a spacing from the housing 1, in particular, from the set screw 57 of the slip clutch 50. Owing to this elevated placement of the brake 6, the set screw 57 remains easily accessible from outside for the adjustment. Also, this elevated placement of the brake 6 makes it possible to use a standard brake with small borehole diameter, since the end of the transmission input shaft 14 facing the brake 6 can have a small diameter in this region, and there can be access to the set screw 57 from the side. In this design, the transmission input shaft 14 does not need to be a hollow shaft, as described above.

Furthermore, the first gear 18*a* and the second gear 18*b* have a corresponding spiral gearing, which is chosen so that the slip clutch 50 when hoisting the load; i.e., in normal direction of force flow, is further compressed by the axial gearing force produced in this way, and thus the frictional engagement is increased.

When the chain is interlocked, for example, by a chain node at the no-load side, where a chain magazine (not shown here) is located, a reversal of the direction of force flow in the transmission 3 will occur. In this case, the axial force of the gearing then opposes the pretensioning of the spring element 53 and the torque releasing the slip clutch 50 is reduced. The tension force of the chain and the loading of the transmission 3 will be reduced. This, likewise, lessens the danger of damaging the chain block.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A chain block, comprising:

a drive motor and an at least one-stage transmission;

said drive motor having a motor shaft, said transmission having an input shaft, said motor shaft connected at a take-off side via a slip clutch to said transmission input shaft;

said transmission having a first gear mounted in a housing via a first pivot bearing and a second pivot bearing; and wherein said transmission input shaft is mounted floating in said first and second pivot bearings in order to affect the frictional force of said slip clutch; and wherein said transmission input shaft has a pinion that is configured in a spiral gearing so that, during operation of the chain block, the axial force produced by said spiral gearing leads to a changing in frictional force of said slip clutch in a lengthwise direction of said transmission input shaft.

2. The chain block of claim 1 wherein said slip clutch is arranged near said first gear on said transmission input shaft and thrusts against one of said pivot bearings.

3. The chain block of claim 2 wherein the axial force produced by said spiral gearing results in an increasing of the frictional force of said slip clutch at least when said chain block is hoisting.

4. The chain block of claim 2 wherein said slip clutch comprises a pressure disk that thrusts against said first pivot bearing and a clutch disk with a clutch lining, wherein said transmission input shaft thrusts against said clutch disk.

5. The chain block of claim 1 wherein the axial force produced by said spiral gearing results in an increasing of the frictional force of said slip clutch at least when said chain block is hoisting.

6. The chain block of claim 5 wherein said slip clutch comprises a pressure disk that thrusts against said first pivot bearing and a clutch disk with a clutch lining, wherein said transmission input shaft thrusts against said clutch disk.

7. The chain block of claim 1 including a brake that is arranged at an end of said transmission input shaft away from said slip clutch and acts on said transmission input shaft.

8. The chain block of claim 7 wherein said brake is configured as an electromagnetically operated disk brake.

9. The chain block of claim 8 wherein said slip clutch comprises a pressure disk that thrusts against said first pivot bearing and a clutch disk with a clutch lining, wherein said transmission input shaft thrusts against said clutch disk.

10. The chain block of claim 1 wherein said slip clutch comprises a pressure disk that thrusts against said first pivot bearing and a clutch disk with a clutch lining, wherein said transmission input shaft thrusts against said clutch disk.

11. A chain block, comprising:

a drive motor and an at one-stage transmission;

said drive motor having a motor shaft, said transmission having an input shaft, said motor shaft connected at a take-off side via a slip clutch to said transmission input shaft;

said transmission having a first gear mounted in a housing via a first pivot bearing and a second pivot bearing; and wherein said transmission input shaft is mounted floating in said first and second pivot bearings in order to affect the frictional force of said slip clutch, wherein one end of said transmission input shaft is thrust against said second pivot bearing across a spring element in order to activate said slip clutch, wherein pretensioning of said spring element is adjusted by said first pivot bearing being adapted to travel lengthwise in said housing and be moved in a direction of said spring element by a set screw thrusting against said housing.

12. The chain block of claim 11 wherein said spring element comprises flat spring elements.

13. The chain block of claim 12 wherein said slip clutch comprises a pressure disk that thrusts against said first pivot bearing and a clutch disk with a clutch lining, wherein said transmission input shaft thrusts against said clutch disk.

14. The chain block of claim 11 including a brake that is spaced from said housing at a distance established by said set screw.

15. The chain block of claim 11 wherein said slip clutch comprises a pressure disk that thrusts against said first pivot bearing and a clutch disk with a clutch lining, wherein said transmission input shaft thrusts against said clutch disk.

* * * * *